United States Patent [19]

Schuman

[11] 4,072,010

[45] Feb. 7, 1978

[54] THERMALLY DRIVEN PISTON APPARATUS

[76] Inventor: Mark Schuman, 101 G St., SW. Apt. 516, Washington, D.C. 20024

[21] Appl. No.: 740,486

[22] Filed: Nov. 10, 1976

Related U.S. Application Data

[63] Continuation of Ser. No. 592,895, July 3, 1975, Pat. No. 4,012,910.

[51] Int. Cl.[2] ..... F02G 1/04

[52] U.S. Cl. ..... 60/520; 417/207

[58] Field of Search ..... 60/520; 417/375, 207

[56] References Cited

U.S. PATENT DOCUMENTS

| | | | |
|---|---|---|---|
| 3,767,325 | 10/1973 | Schuman | 60/520 X |
| 3,782,859 | 1/1974 | Schuman | 417/207 |
| 4,012,910 | 3/1977 | Schuman | 60/520 |

*Primary Examiner*—Allen M. Ostrager
*Attorney, Agent, or Firm*—Schwartz & Weinrieb

[57] ABSTRACT

A closed cylinder contains a thermally driven free piston oscillating between hot and cold ends of the cylinder which ends are respectively connected to a thermal lag heating chamber and a turbine/cooling chamber. A thermal regenerator is provided within a cylinder bypass which bypasses a portion of the cylinder between hot and cold rebound chambers which include, respectively, the hot and cold ends of the cylinder. The hot rebound chamber also includes the thermal lag heating chamber. The heating chamber has sufficient thermal lag properties for substantially heating gas therein as the piston is rebounding away from the hot end of the cylinder, thereby sustaining piston oscillation. The cyclical heating and cooling of the working gas in the heating and cooling chambers and in the regenerator as the displacer piston coasts up and down within the bypass region of the cylinder between the rebound chambers produces a modulated pressure for driving the turbine via a nozzle-like conduit interposed between the cylinder and the turbine. The modulated pressure is augmented by orienting the hot end of the bypass and an inlet port of the thermal lag heating chamber so that, while the piston is coasting toward the cold end of the cylinder, gas flowing into the hot end of the cylinder via the bypass is directed into the cylinder in a stream which passes into the heating chamber inlet port and thence into the heating chamber for further heating therein while the piston is still coasting toward the cold end of the cylinder. The overall cycle of this heat engine is regenerative and may loosely be referred to as a modified Stirling cycle. The turbine or motor may drive a generator or alternator to produce electrical power. The turbine may be replaced by a different rotary motor or other fluid driven load.

42 Claims, 3 Drawing Figures

THERMALLY DRIVEN PISTON APPARATUS

This is a continuation of application Ser. No. 592,895 filed July 3, 1975, now U.S. Pat. No. 4012,910

BACKGROUND OF THE INVENTION

1. Field of the Invention

The present invention relates generally to energy converters and more particularly to an energy converter which utilizes a regenerative gas cycle and an oscillatory gas flow through the regenerator.

2. Description of the Prior Art

Various energy converters have been previously disclosed utilizing a modified Stirling cycle and a free or semi-free piston which alternately displaces gas back and forth between a hot space (a hot chamber) and cold space (a cold chamber) via a thermal regenerator as the piston oscillates in a cylinder. The temperature difference between the hot and cold chambers is maintained by means of a heating means or chamber and a cooling means or chamber and this alternate displacement of gas causes an alternate heating and cooling of the gas by the heating and cooling chambers and by the regenerator connecting these two chambers. This alternate heating and cooling results in a cyclical variation or modulation of the gas pressure. This modulated pressure may in turn be used to drive a load, such as a working piston, which may also be a free piston and which typically oscillates up to about 90° out of phase with respect to the displacer piston, and the oscillating working piston may do mechanical, pneumatic, or electro-magnetic work. The displacing and working pistons may also be combined so as to form a single complex piston having a displacing piston mounted on a working piston and moving relative to the working piston to accomplish its function. Or, the displacing piston may be porous and act as an oscillating regenerator to accomplish its function.

The modulated pressure energy developed by means of the displacing or working piston can be used for fluid pumping purposes by means of check valves which rectify the modulated pressure, or, as described within my copending application, Ser. No. 502,748, filed Sept. 3, 1974, now U.S. Pat. No. 3,973,771 entitled Illusion Amusement Device and as also described and illustrated herein, a pressure driven load, such as for example, a turbine, may be driven directly by such a device without the use of check valves, by means of the pressure modulated fluid of such a device issuing from a nozzle which directs the reciprocating fluid against the load.

I have previously invented a free piston, Stirling type device such as described above and various embodiments of this device are described and illustrated within my U.S. Pat. Nos. 3,782,859, entitled "Free Piston Apparatus, " and 3,767,325, entitled "Free Piston Pump." The free piston of this device can be of simple and integral construction, and it is a completely free piston. The piston is reversed by means of a gaseous spring, which does not wear out, as compared with a mechanical spring, and the means for reversing the direction of motion of the free piston, twice each cycle, is relatively independent of the load, whereby the device is essentially stall-free. Since the free piston is guided by means of the cylinder itself, there is no need for a separate guidance apparatus or for accurate alignment of such a guidance apparatus with the cylinder. In addition, in the simplest form of my device, the single free piston is the only moving part required for developing the cyclical pressure variation. To my knowledge, none of the other Stirling-type free piston energy converters have all of these advantageous features.

However, my approach to this family of devices appears to have a slight disadvantage which most, if not all, of the other devices do not have. In one of its simplest forms, my device has a single heating chamber. The sole heating chamber, in contrast with the other devices, serves as a thermal lag heating chamber for driving the free piston and, also in contrast with these other devices, the sole heating chamber is not located in the cylinder bypass, where it would each cycle heat substantially all of the gas forced from the cold chamber to the hot chamber via the bypass. Instead, the sole heating chamber is disposed outside of the bypass and communicates with the hot end of the cylinder by means of a separate heating chamber port which is located beyond the bypass. The heating chamber port is located in or very near the hot end-wall of the cylinder, whereby the heating chamber communicates with the hot end of the cylinder while the hot bypass port is blocked by the piston side-wall during the hot rebound portion of the cycle, during which portion of the cycle the heating chamber functions not only as part of the hot rebound chamber but also as a thermal lag heating chamber for sustaining piston oscillation (see my U.S. Pat. No. 3,807,904, entitled "Oscillating Piston Apparatus," for a relatively thorough description of a thermal lag heating chamber; my U.S. Pat. No. Re. 27,740, entitled "Oscillating Free Piston Pump," also discusses thermal lag heating).

The heating of the gas forced by the piston into the heating chamber during this hot rebound portion of the cycle, in addition to the heating of the gas forced into the heating chamber during the next portion of the cycle as a result of the increasing pressure in the cylinder while the piston coasts within the bypass region in a direction away from the hot cylinder end, combine to essentially provide the cyclical heating by the heating chamber of gas forced from the cold chamber to the hot chamber via the regenerator in the bypass. While it is normally desirable for all of the gas being forced through the regenerator to be heated by the heating chamber each cycle, and while this goal is apparently substantially accomplished by the other Stirling type devices of which I am aware, it is difficult to say, in the case of my device, just how much of this forced gas enters the sole heating chamber of my simplified device each cycle during the above two portions of my cycle. Certainly a substantial amount of such gas does enter my heating chamber for heating therein such cycle; however, this amount may well be substantially less than 100% of such gas, the main problem occurring during the above-mentioned coasting portion of the cycle while the piston iscoasting in the bypass region in a direction away from the hot end of the cylinder (toward the cold end of the cylinder) primarily because the bypass flow is not angled toward the heating chamber. Although the advantages of my approach, discussed first, may out-weigh this slight disadvantage, discussed last, it nevertheless is the prime object of the present invention to correct this slight deficiency without introducing any new deficiency.

SUMMARY OF THE INVENTION

The present invention is a modified Stirling cycle energy converter which utilizes, as in the case of my Free Piston Apparatus and my Free Piston Pump, referenced above, a cylinder, a cylinder bypass containing a regenerator, a free piston oscillating within the cylinder between hot and cold ends of the cylinder, a gaseous rebound chamber at each end of the cylinder beyond the bypass, one of the rebound chambers including a thermal lag heating chamber for supplying heat energy to the gas for sustaining the piston oscillation; and a cooling chamber for cooling gas flowing into the cold end of the cylinder. However, within the present invention, the cooling chamber is provided by a load in the form of a turbine which is connected pneumatically, with or without the use of check valves, to the cold end of the cylinder so as to be driven by means of the oscillatory temperature and pressure developed within the cylinder/turbine system as a result of both the alternate and simultaneous heating and cooling of the gas (or other compressible fluid). The thermal lag heating chamber is connected to the opposite, or hot, end of the cylinder and, also in contrast with the two last named patents, the bypass and heating chamber are constructed, oriented, and connected to the hot end of the cylinder in such a manner as to utilize the nozzle effect of the hot bypass conduit such that the fluid flowing through the bypass into the hot end of the cylinder is directed by the hot bypass conduit into the cylinder in a concentrated stream which flows toward and thence into and perhaps even through the heating chamber for heating therein as the piston coasts within the bypass region in a direction toward the cold end of the cylinder. Thus, the thermal lag heating chamber not only operates to heat the working gas during the hot rebound portion of the cycle (while the hot end of the bypass is blocked by means of the piston), for sustaining piston oscillation, but also serves as a heating chamber for heating substantially all of the fluid flowing into the hot end of the cylinder via the bypass while the piston is coasting toward the cold end of the cylinder.

Accordingly, it is an object of the present invention to provide a new and improved energy converter utilizing a free oscillating piston.

Another object of the present invention is to provide a new and improved energy converter utilizing a modified Stirling cycle, wherein the energy converter utilizes a cylinder containing a free piston which oscillates within the cylinder between hot and cold ends of the cylinder. The cylinder has a bypass which contains a regenerator and which bypasses a sufficient portion of the cylinder so that the piston coasts while it is within the bypass region. A hot rebound chamber is provided at the hot end of the cylinder beyond the bypass for reversing the piston motion and includes a thermal lag heating chamber communicating with the hot end of the cylinder for driving the piston during the hot rebound portion of the oscillatory cycle. The thermal lag heating chamber and the hot end of the bypass are configured, oriented, and connected to the hot end of the cylinder such that, while the piston is coasting in a direction toward the cold end of the cylinder, most, or even substantially all, of the fluid flowing into the hot end of the cylinder via the bypass is directed by means of the bypass is a stream which flows to, and thence into, the thermal lag heating chamber for heating therein during this coasting portion of the cycle.

A further object of the present invention is to provide a new and improved energy converter utilizing a free piston oscillating within a cylinder between hot and cold ends thereof, a bypass containing a regenerator and bypassing a portion, and only a portion, of the cylinder, the bypass connecting the hot and cold ends of the cylinder together while the bypass is not blocked by the oscillatory piston. Means are also provided for heating fluid flowing into the hot end of the cylinder and for feeding cool fluid into the cold end of the cylinder, the hot end of the bypass being connected to the cylinder side-wall at an acute angle with respect to the cylinder axis so that fluid flowing into the hot end of the cylinder via the hot end of the bypass has a velocity component along the cylinder axis in a direction away from the cold end of the cylinder, such angling of the hot bypass end tending to improve the power output and efficiency of the energy converter.

An additional object of the present invention is to provide a new and improved energy converter utilizing a modified Stirling cycle, wherein the displacing piston is in the form of a free piston which coasts within a bypass region of a cylinder, wherein the working member of the energy converter is a turbine, and wherein the turbine housing provides cooling for energy converter.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF A PREFERRED EMBODIMENT

Figure 1:
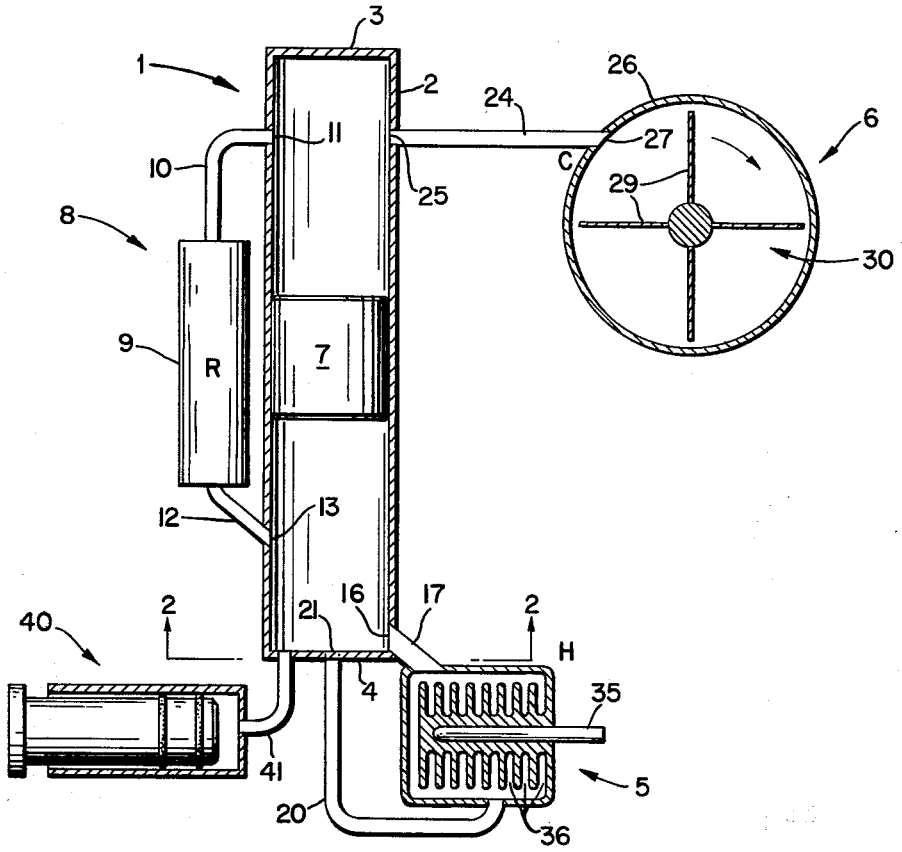
FIG. 1 is a cross-sectional view of a modified Stirling-cycle energy converter utilizing a free oscillating piston as a displacer piston, a turbine as the working member, and a cylinder bypass which, at its hot end, is angled toward a thermal lag heating chamber inlet port in the cylinder wall beyond the bypass for directing fluid from the bypass into the heating chamber for augmenting the cyclical heating and cooling of the working fluid, thereby increasing the resultant efficiency and power output of the device.

Reference now being made to FIG. 1, there is illustrated a closed cylinder, generally indicated by the reference character 1, having a side-wall 2, and end-walls 3 and 4 at opposite ends of the cylinder. As a result of a thermal lag heating chamber; generally indicated by the reference character 5, and a turbine/cooling chamber, generally indicated by the reference character 6, which are respectively connected to opposite ends of the cylinder, as more particularly described later, the cylinder 1, during operation, has a cold end adjacent and including end wall 3 and a hot end adjacent and including end wall 4. A free piston 7 oscillates between and separates the hot and cold ends of cylinder 1 and the cylinder also has a bypass, generally indicated by the reference character 8, containing a regenerator 9.

The regenerator 9 and bypass 8 communicate with the cold end of the cylinder by means of a cold bypass conduit 10 terminating in a cold bypass port 11 in the side-wall 2 of the cylinder in the cold end of the cylinder, and similarly, the regenerator and bypass are connected to the hot end of the cylinder by means of a hot bypass conduit 12 which terminates in a hot bypass port 13 in the cylinder side-wall 2 in the hot end of the cylinder. Thus, the bypass connects the hot and cold ends of the cylinder via the bypass 8 (and regenerator 9) while free piston 7 is coasting in either direction within the cylinder bypass region between bypass ports 11 and 13. The coasting of the piston is facilitated by means of the low fluid flow impedance of the cylinder bypass, which impedance is the same for fluid flow in either direction through the bypass. The coasting steps, however, when the side-wall of the piston 7 traverse either of the ports 11 or 13, at which time the bypass port and bypass are blocked or restricted by the piston side-wall and the piston then compresses the gas within the corresponding end of the cylinder. The compression of the gas causes the piston to rebound away from this end of the cylinder toward the opposite end of the cylinder, and thus, the cycle of piston oscillation has two coasting portions interspersed with two rebound portions.

As the piston coasts toward the cold end of the cylinder, that is, coasts upward as seen in FIG. 1, which may arbitarily be considered as the first coasting portion of the oscillatory cycle, cold gas is forced by the piston downwardly through the bypass and into the hot end of the cylinder. The regenerator, during operation, has a positive temperature gradient directed toward the hot end of the cylinder, because of the alternate flow of the cold gas downward and the hot gas upward within the bypass and through the regenerator, and consequently, the cold gas forced downwardly through the bypass by the upwardly coasting piston is warmed by the regenerator and simultaneously cools the regenerator before it is directed, by means of the hot bypass conduit 12, into the hot end of the cylinder in a concentrated stream which flows toward and into an inlet port 16 of heating chamber 5. Thus conduit 12 acts as a crude nozzle and guiding means for directing the warmed fluid substantially immediately into the heating chamber for immediate initiation of heating of the fluid by and within the heating chamber.

Figure 2:
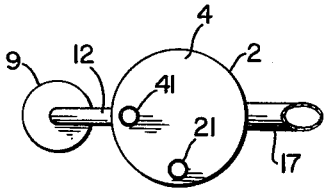
FIG. 2 is a substantially external, bottom view of the hot end of the cylinder, bypass, and heating chamber inlet conduit of FIG. 1, taken along the line 2—2 of FIG. 1.

Heating chamber inlet port 16 may be in the cylinder side-wall 2 on the opposite side of the cylinder axis from bypass port 13, that is, 180° around the cylinder from port 13, as illustrated in FIGS. 1 and 2, and is further from the cold end of the cylinder than is port 13. Thus the hot bypass conduit 12, and the stream of gas flowing therethrough into the hot end of the cylinder, are oriented at an acute angle with respect to the cylinder axis, such that this flow of warmed or heated gas through hot bypass port 13 and into the hot end of the cylinder has a substantial velocity component along the cylinder axis in a direction away from the cold end of the cylinder.

Heating chamber inlet port 16 is connected to heating chamber 5 by means of heating chamber inlet conduit 17. Thus, substantially all of the warmed gas is directed by means of hot bypass conduit 12 in a stream which flows into, and through a segment of, the hot end of the cylinder, thence through port 16 and conduit 17, and into heating chamber 5 for substantial additional heating therein during this portion of the cycle while the piston is coasting toward the cold end of the cylinder. Port 16 may, as shown in FIG. 1, have a larger cross-sectional area than that of port 13 so as to facilitate entry of substantially all of the directed stream into conduit 17 and heating chamber 5. In addition, conduit 17 has a mean flow axis which is approximately aligned with the mean flow axis of conduit 12 so as to further facilitate passage of the stream into heating chamber 5.

Heating chamber 5 may also have an optional, separate outlet conduit 20 which communicates with the hot end of the cylinder by means of a heating chamber outlet port 21 which, as illustrated in FIG. 1, may be in the hot end wall 4 of the cylinder. By allowing the gas to return to the hot end of the cylinder after being heated within the heating chamber, entry of the directed gas stream via port 16 and conduit 17 into the heating chamber is further facilitated. Conduit 20 and port 21 facilitate passage or circulation of most of the directed fluid completely through the heating chamber and back into the hot end of the cylinder during the first coasting portion of the cycle. The increased circulation of the fluid through the heating chamber increases the heating of the directed fluid in the heating chamber during the first coasting portion of the cycle, thereby producing a greater pressure increase in the cylinder during this first coasting portion of the cycle. In addition, it should be noted that conduit 20 and port 21 are oriented, located, and configured so as to avoid interference with the above-mentioned directed stream by the gas returning from the heating chamber to the hot end of the cylinder via port 21, as will be discussed below in connection with FIG. 2. Thus, because of these features, substantially all of the directed stream from the hot end of the bypass enters, and is heated by and within, the heating chamber during this first coasting portion of the cycle, causing a substantially greater increase in the gas pressure within the cylinder during this upward coasting portion of the cycle than occurred in my above-mentioned Free Piston Apparatus and Free Piston Pump which did not feature a bypass angled toward a thermal lag heating chamber inlet port. If port 16 and conduit 17 are quite large, the directed fluid may circulate both into and out of the heating chamber via this port and conduit during the first coasting portion of the cycle, whereby the advantages of conduit 20 and port 21 for facilitating the desired flow of fluid into and out of the heating chamber during this first coasting portion of the cycle are diminished, whereby conduit 20 and port 21 become less necessary and desirable. Port 16 may alternatively be located within the hot end wall 4 of the cylinder.

This increasing pressure, due to the heating of the fluid by and within the regenerator and heating chamber as the piston coasts toward the cold end of the cylinder, forces gas from the cold end of the cylinder into turbine 6 via load conduit 24. Load conduit 24 communicates with the cylinder by means of load port 25 in the cylinder side-wall and also communicates with the interior of the housing 26 of the turbine by means of a turbine housing port 27. Conduit 24 acts as a crude nozzle so as to direct the gas in a stream toward blades 29 of the turbine rotor 30 as each of the blades is disposed above the rotor axis and opposite port 27. The directed stream is deflected by the blades 29, thereby providing impulses against the blades which drive rotor 30 in a clockwise direction as denoted by the arrow. As the rotor spins, the additional rotor blades successively come into line with the conduit or nozzle 24 and are in turn driven by means of the directed stream. The turbine rotor may be connected to an alternator or generator, thereby converting the heat energy into electrical energy, or, alternatively, the turbine may drive other types of loads.

The fluid stream, after deflection by the rotor blades, is cooled by the turbine housing 26, thus concentrating the gas within the turbine and tending to reduce the pressure in the turbine, thereby augmenting the gas flow into the turbine, whereby greater pneumatic power for driving the turbine is derived as a result of this cooling of the working fluid by the turbine housing 26. Various means, not shown, may of course be provided for cooling the housing 26, such as for example, cooling fins and a fan.

One preferred position for load port 25 is a location having the same longitudinal position along the length of the cylinder as that of cold bypass port 11, as illustrated in FIG. 1. Thus, ports 11 and 25 are the same distance from cold end wall 3 of the cylinder, and in this manner, the upward coasting piston simultaneously blocks and restricts flow through cold bypass port 11 and load port 25 by means of the traversal of these ports by the piston sidewall, whereupon the coasting away from the hot end of the cylinder stops and the piston compresses the gas trapped within the upper or cold rebound chamber comprising the cold cylinder end. It is noted that the cold rebound chamber acts as a gaseous compression spring for slowing, stopping, and reversing the direction of motion of the piston during this cold rebound portion of the oscillatory cycle.

Subsequently, the second coasting portion of the cycle commences as the free piston unblocks ports 11 and 25 and coasts away from the cold end of the cylinder, thereby forcing hot gas from the hot end of the cylinder to the cold end of the cylinder via the bypass. This flow of gas in the bypass heats the regenerator, and the gas in turn is cooled by the regenerator as it is fed into the cold end of the cylinder during this second coasting portion of the cycle. The cooling of the gas in the bypass causes a drop in the cylinder pressure which draws cooled gas from the turbine back into the cold end of the cylinder via the load conduit 24 and ports 27 and 25.

The gas flowing into port 27 and conduit 24 during this second coasting portion of the cycle is drawn diffusely from within the turbine housing, and this diffuse flow retards the rotation of the turbine rotor almost insignificantly. This is contrasted with the nozzle or directional stream effect occurring when gas flows from the cylinder into the turbine via nozzle 24 and port 27 during the first coasting portion of the cycle, which nozzle effect causes substantial work to be done by the gas upon the rotor 30. I have built a simple, thermally driven, free piston/turbine model which demonstrates this asymmetric nozzle effect, as well as some of the other features of the device illustrated in FIG. 1.

Free piston 7, which is coasting away from the cold end of the cylinder, eventually reaches and traverse the hot bypass port 13 and therefore blocks flow in the bypass, whereupon this second coasting portion of the cycle terminates and the piston compresses the gas in the hot rebound chamber comprising the hot end of the cylinder, heating chamber 5, and conduits 17 and 20. The hot rebound chamber acts as a gaseous spring so as to reverse the direction of the piston motion and to cause the piston to rebound away from the hot end of the cylinder and to move toward the cold end of the cylinder. During this hot rebound portion of the cycle while port 13 is blocked by the piston, the piston first draws a small amount of gas from the turbine and then, after the piston motion is reversed, forces a small amount of gas into the turbine, thereby doing a small amount of work upon the turbine during the hot rebound cyclic portion. The hot rebound portion of the cycle ends when the hot bypass port 13 is uncovered by the piston, the cycle of piston oscillation thereby being completed. The piston then begins coasting away from the hot end of the cylinder, that is, the piston commences the first portion of the next cycle.

The heating chamber 5, which is heated by an external heat source 35, has, of course, a higher temperature than the hot end (the lower end) of the regenerator. The heating chamber 5 has sufficient thermal lag properties, so that the gas within the heating chamber (and thus the gas within the hot rebound chamber) is heated continuously by the heating chamber (and perhaps also by the hot end of the cylinder) throughout the hot rebound portion of the cycle, so as to augment the speed and kinetic energy of the piston as it rebounds toward the cold end of the cylinder, thereby sustaining piston oscillation. This continuous heating is facilitated if the heating chamber contains at least one heated passageway which is elongated and has a length and breadth which are substantially greater than the passageway width, several of such thermal lag passageways being illustrated in FIG. 1 as passageways 36 (see my U.S. Pat. NO. 3,807,904 for a discussion of thermal lag driving of a piston). Also, the passageway width is typically greater than the width of a heated passageway of a conventional heating chamber.

This continuous or substantially continuous heating of the gas in the hot rebound chamber during the hot rebound cycle portion causes the mean gas temperature, and therefore also the pressure, of the gas within the hot rebound chamber to substantially lag the instantaneous geometrical compression ratio of the hot rebound chamber (the ratio of maximum volume to instantaneous volume), whereby the maximum temperature, and the maximum pressure, within the hot rebound chamber are attained substantially after the maximum instantaneous compression ratio is reached and while the piston is accelerating away from the hot end wall 4. Thus there is a substantially greater average pressure in the hot rebound chamber and against the lower face of the piston while the piston is rebounding away from the hot end wall 4 than the average pressure is the hot rebound chamber during the early part of the hot rebound portion of the cycle while the piston is moving toward the hot end wall 4 of the cylinder. This produces a substantially greater piston kinetic energy at the end of the hot rebound portion of the cycle than at the beginning of the hot rebound portion of the cycle, even allowing for some energy loss due to such factors as sliding friction, viscous losses, and leakage of gas between the piston and cylinder sidewalls, as well as the small amount of work done by the piston upon the turbine (via the working gas) during the hot rebound portion.

This thermo-pneumatic augmentation of the piston energy, during the hot rebound portion of the cycle, is sufficient to overcome various piston energy losses throughout the cycle, such as to example, piston-cylinder leakage, thermal transfer losses between the gas and its enclosing walls, and viscous losses, such as for example, windage within the regenerator, so that the piston oscillation is nevertheless sustained in spite of these losses. The thermal lag heating is also sufficient to maintain piston oscillation in spite of most any severe load on the device, such as, for example, a complete stalling of the turbine (a very unlikely event). This is because the piston is essentially a displacer piston rather than a working piston, whereby its oscillation is essentially independent of the load, because of the bypass. Thus, the load is driven primarily by the alternate heating and cooling of the gas rather than by direct compression of the gas by the piston.

It should also be understood that the heating of the gas required during the hot rebound portion for sustaining piston oscillation is also contingent upon the directed stream, flowing into port 16 from the bypass, being cooler than the heated passageways 36 that must heat this fluid. Thus the means for sustaining piston oscillation must include either a cooling of the working fluid elsewhere in the device during a portion of the cycle, such as for example, within the turbine, or some other means in addition to the regenerator for feeding cool gas into the cylinder, such as for example, by means of a cooling chamber in the bypass, or a supply of cold gas being pumped by means of the energy converter.

The hot and cold ends of the cylinder may be thought of as first and second variable volumes separated by the free piston. The bypass connects the first and second volumes but is restricted when either of the volumes has values in a minimum range, as a result of blockage of the bypass ports by the piston.

A simple, manually operated, piston-cylinder type starter 40, connected pneumatically to the lower end of the cylinder by means of a starter conduit 41, provides a pneumatic impulse against the piston for initiating the piston oscillation.

Referring now to FIG. 2, there is illustrated therein a bottom view of the cylinder, the bypass, and the heating chamber inlet conduit of FIG. 1, as viewed in the direction of arrows 2—2 in FIG. 1. Shown in this substantially external view of the hot end of the cylinder is port 21 by which port the heating chamber outlet conduit 20 communicates with the hot end of the cylinder. Port 21 is provided in the hot end wall 4 of the cylinder and is offset from the cylinder axis so as to avoid undue interference by the fluid flowing into the hot end of the cylinder via the port 21 with the directed hot bypass fluid stream flowing from hot bypass port 13 toward and into heating chamber inlet port 16.

Figure 3:
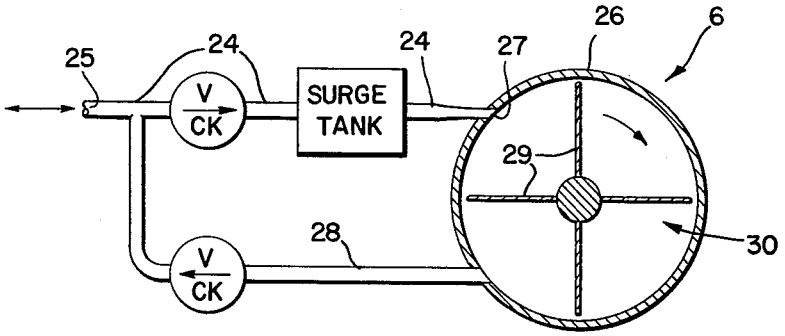
FIG. 3 is a partial, cross-sectional, schematic view showing an alternative connecting means between the turbine and the cylinder.

As illustrated in FIG. 3, there is shown an alternate connecting means between the cylinder and the turbine. The alternate connecting means is not believed to provide any additional novelty, and thus is not described in great detail. However it is seen that the alternate connecting means essentially comprises conduit 24, modified so as to include a check valve and surge tank in order to provide a smooth unidirectional flow from the nozzle to the turbine. The alternate connecting means further includes a substantially separate return path or conduit 28 for the gas returning to the cold end of the cylinder from the turbine, the return path containing a second check valve for obtaining unidirectional flow in the return path from the turbine to the cold end of thecylinder. The alternate connection reduces the small amount of power lost due to the periodic backward flow through the nozzle; however such connection also adds some complexity, service lifetime considerations, and small power losses of its own.

The working fluid of this device can be a gas, a vapor, or most any compressible fluid. Some liquid may be present, but it must not interfere too much with the piston oscillation. Of course, some gases would provide a greater thermodynamic efficiency than others.

The turbine is only one example of a load for the thermally powered source of oscillatory pressure variation described herein; other fluid-driven rotary or non-rotary motors or other loads may of course be driven by means of this device. By using check valves, the device may be used for unidirectionally pumping or compressing gas. The thermal energy required for the cooling and heating operations described above for operating the device can be derived from the gas or other fluid being pumped, or from other pressure driven loads. A cooling chamber may be located in the bypass between the regenerator and the cold end of the cylinder to provide the required cooling; similarly a heating chamber may be disposed in the bypass between the regenerator and the hot end of the cylinder as long as it does not heat the fluid in the bypass so much that it destroys the ability of the thermal lag heating chamber to further heat the fluid sufficiently to sustain the piston oscillation.

The configuration of the heating chamber of this device can be adapted in various ways to absorb and utilize heat from most any heat source - even solar heat. For example, the energy converter of this invention could be used to convert solar radiant energy into electrical energy, for purposes such as providing electrical energy for a home. Thus the solar energy can be focused or semi-focused onto a radiation collector which is configured to act as the heating chamber of the engine of this invention. The waste heat discharged by the engine, for example the heat drawn from the turbine housing by a fan which cools the turbine housing, can be used to heat the home, to heat hot water for the home, and even to supply heat for air conditioning the home (by replacing the gas flame of a gas powered air conditioning unit) (or air-conditioning can be provided by using one engine, less the turbine, running "forward," as described herein, to drive a modified second engine running "backard " to provide cooling - see FIG. 16 of my U.S. Pat. No. 3,782,859). Another example of a heat source for powering the engine of the present invention is a flame — as from burning a fuel, such as for example, kerosene, propane, wood, or even garbage. Most any source of waste heat may be used if a sufficient temperature differential is available.

The thermal lag heating technique does not appear to be a very powerful means for driving the free piston, and it may or may not be a highly efficient means for driving the piston, but it does not need to be either a powerful or efficient piston driving means since the piston, because of the bypass and regenerator, is primarily a displacer piston rather than a working piston, and therefore requires relatively little energy to sustain its oscillation, especially if the cylinder is vertically oriented, which orientation practically eliminates piston — cylinder friction. In addition, the thermal lag heat energy which is not converted into piston kinetic energy is essentially not wasted since it provides the required cyclical heating of the working gas and therefore facilitates development of the Stirling type pressure variation for doing work upon the load while the piston is coasting up and down in the cylinder, and therefore is efficiently used. Thus, the work done upon the turbine or other load comes essentially from the heating and cooling operations and not from direct compressive work by the piston. The primary purpose of the piston is thus to cyclically displace the gas in order to facilitate the heating and cooling in the desired cyclical manner, whereby the energy required to sustain the piston oscillation is much less than if the piston were a working piston which more directly performed work upon the load. For these reasons, it is feasible for the free piston of this invention to be driven in the simple, thermal lag manner.

Besides simplicity, another advantage of avoiding the use of a working piston as the primary moving part of the engine is that the displacer piston oscillation is affected relatively little by the load, whereby the energy converter is essentially stall-free, because of the bypass and the thermal lag means for sustaining piston oscillation. For example, if the rotor 30 were held stationary, piston oscillation would continue as long as the heating and cooling rates were adequate. Or, if there were no rotor and the single free piston device were used as a pump for storage of gas in high and low pressure surge tanks, neither a large nor a zero difference in pressure between the two tanks would stall the piston assuming adequate heating and cooling were still provided.

For generating electrical power, one advantage of using a turbine instead of a working piston, as the working member of the engine, is the higher speed of the turbine which does not have to stop twice each cycle as a working piston does. A high turbine speed is further facilitated by the high speed gas flow through conduit 24 which has a much smaller cross-sectional area for flow than does cylinder 1. This difference in cross-sectional area acts as a gas speed multiplying factor for augmenting the rotational speed of the turbine. Thus, the piston-cylinder of this invention can serve as a Stirling-type compressor for a turbine in place of the usual turbo-compressor. This substitution is especially advantageous when the engine is of small or medium size, since conventional turbo-compressors become very inefficient in small sizes. The simplicity, long life, silent operation and low cost are also advantages, no matter what the driven load may be.

The device can be turned upside down without increasing the piston-cylinder friction, whereby the hot end of the cylinder and the heating chamber would then be on top and the cold end of the cylinder, and perhaps the starter, would be on the bottom. In addition, the device can also be operated at any other angles within a gravitational field as long as the higher piston-cylinder friction can be accommodated by the means for sustaining piston oscillation.

In the device of FIG. 1, the piston can be reversed in direction at the top of the cylinder merely by gravity, if the cold bypass port is higher than the uppermost travel of the upper face of the piston. The cold rebound chamber as described herein would not then be necessary.

Since the piston is not a working piston, it can be very light, whereby the energy required to reverse its direction of motion and sustain its oscillation is small. Another advantage of the piston being light in weight is that piston-cylinder friction is low even when the cylinder is not vertical. A further advantage of the light weight or low mass of the piston is that the vibration of the device would be minimal. However, if it is desired to eliminate any tendency of the device to vibrate along the cylinder axis, two in-line cylinders may be used, with the pistons synchronized to move in phase in opposite directions by suitable synchronizing means, such as, for example, described and/or illustrated in my patents referenced hereinabove. While my thermally powered model does not demonstrate all of the features illustrated in FIG. 1, it does utilize the basic configuration described and/or illustrated in by above-mentioned patents for obtaining synchronization. The model demonstrates two thermally powered free pistons oscillating synchronously and oppositely, whereby the tendency of the device as a whole to vibrate is essentially zero.

The turbine may alternatively be connected to the cylinder at positions thereof along the cylinder axis other than the illustrated position, such as for example, at the cold end wall of the cylinder or, if the turbine housing is not cooled, at the hot end of the bypass region. Still further, the turbine housing may be heated and the turbine used as a thermal lag heating chamber in place of the chamber 5. It would then communicate with the cylinder as does chamber 5, and cooling for the energy converter could then be provided by means such as a cooling chamber in the bypass between the regenerator and the cold bypass port. However, if the turbine is operated hot, as in these last two examples, there probably would be some undesirable transfer of heat to the turbine bearings, as well as perhaps some undesirable heat flow to a generator or alternator driven by the turbine.

Free piston 7 is of simple and integral construction, and thus, all segments of the free piston move together as a unit and the cross-sectional dimensions of the piston are constant throughout the length of the piston.

The terms hot, warm, cool, and cold, as used herein, are relative terms. For example, the cold end of the cylinder may feel warm or hot to the touch even though it is cooler than the hot end of the cylinder. Either of the terms warm or hot implies a higher temperature than either of the terms cool, or cold.

The thermodynamic cycle of the present invention is essentially regenerative but, strictly speaking, it utilizes neither a Stirling cycle nor an Ericsson cycle, both of which are regenerative gas cycles. However, because Stirling type engines are relatively well known and utilize a displacer piston, the device may, in a broad sense, be referred to as a Stirling type device, and the cycle may loosely be referred to as a modified Stirling cycle.

Due to the motion of piston 7 as well as the movement of heated gas returning from heating chamber 5 to the hot end of the cylinder, during the first coasting portion of the cycle, the heated fluid stream directed into the hot end of the cylinder by the hot bypass conduit may not travel exactly in a straight line toward the heating chamber inlet port. The particular geometry of the hot end of the cylinder, with its deflecting surfaces, may also influence the path of the directed stream within the cylinder. Thus, for reasons such as these, the heating chamber inlet port and conduit may have to be disposed somewhat off-axis with respect to the mean flow axis of the hot bypass conduit, in order to readily admit substantially all of the directed stream from the hot end of the bypass.

Although the bypass is described herein as being blocked and unblocked by the piston side-wall, other means can be used to block and unblock the bypass at the proper times, whereby the bypass, in a structural sense, would not necessarily be restricted to bypassing only a portion of the cylinder, and could then theoretically bypass the entire cylinder. Thus, for example, the bypass could be blocked or closed by a pressure sensitive valve or a piston position sensitive valve. As shown in FIG. 7 of my U.S. Pat. No. 3,782,859, for example, a face of the piston can have a rod or nipple which periodically enters a small cylinder at the end of the main cylinder in which the piston travels, and operates a pressure sensitive valve in the small cylinder.

Obviously, many other modifications and variations of the present invention are possible in light of the above teachings. It is to be understood therefore that within the scope of the appended claims, the present invention may be practiced otherwise than as specifically described herein.

What is claimed as new and desired to be secured by letters patent of the United States is:

1. An energy converter comprising:

a cylinder fitted with a free piston sized to form a sliding seal with the cylinder as the piston oscillates between and separates hot and cold ends of the cylinder;

a cylinder bypass bypassing a portion of the cylinder so as to allow a compressible fluid to alternately flow back and forth between said hot and cold ends of the cylinder as the piston coasts in alternate directions between said cylinder ends;

means for cooling the fluid flowing into the cold cylinder end and for heating the fluid flowing into the hot cylinder end thereby producing a cyclical fluid pressure variation utilizable for driving a load;

said heating means including a heating chamber disposed outside of the bypass and communicating with the hot end of the cylinder via a heating chamber inlet conduit, said inlet conduit communicating with the hot end of the cylinder via a heating chamber inlet port defined in the hot end of the cylinder;

said bypass including, in seriatim, a cold bypass port defined in said cold end of the cylinder, a hot bypass conduit, and a hot bypass port defined in the sidewall of the cylinder in said hot end of the cylinder, whereby the fluid exiting the hot end of the bypass via said hot bypass port flows into the hot end of the cylinder in a substantially defined stream during a first coasting portion of the oscillatory cycle while the piston is coasting in the bypass region of the cylinder toward the cold end of the cylinder;

means for positioning and aligning said hot bypass conduit and said heating chamber inlet port with respect to each other and with respect to the hot end of the cylinder so as to augment passage of said fluid in said stream into said heating chamber via said inlet port and said inlet conduit for heating fluid in the heating chamber during said first coasting portion of the cycle;

said piston during a hot rebound portion of the oscillatory cycle blocking said hot bypass port and compressing and forcing fluid from the hot end of the cylinder into said heating chamber for heating therein for expanding and driving said piston toward the cold cylinder end with a greater piston kinetic energy at the end of the hot rebound cycle portion than the kinetic energy of the piston at the beginning of the hot rebound cycle portion; and means for reversing the piston motion at the cold cylinder end.

2. An energy converter as in claim 1, wherein:

said bypass contains a thermal regenerator interposed between said cold bypass port and said hot bypass conduit, wherein said heating means and said cooling means each include said regenerator, said regenerator improving the efficiency of the thermocompressor.

3. An energy converter as in claim 1, wherein:

said cooling means comprises means for connecting the cold end of the cylinder to a cool load.

4. The energy converter of claim 3 wherein:

said load includes a fluid driven rotary motor connected to said cylinder so as to be driven by said fluid in said cylinder.

5. An energy converter as in claim 1, wherein:

said cooling means comprises a cooling chamber disposed in said bypass proximate the cold end of said cylinder.

6. An energy converter as in claim 5, wherein:

said bypass contains a thermal regenerator interposed between said cooling chamber and said hot bypass conduit.

7. An energy converter as in claim 1, wherein:

said cold bypass port is disposed in the sidewall of the cylinder in the cold end of the cylinder.

8. An energy converter as in claim 7, further including:

a load port defined in the cylinder sidewall, said load port being disposed at approximately the same longitudinal position along the length of the cylinder as is said cold bypass port.

9. An energy converter as in claim 1, wherein:

said means for reversing the piston motion at the cold cylinder end includes a gaseous spring action of fluid compressed by the piston in the cold end of the cylinder.

10. An energy converter as in claim 1, wherein:

said heating chamber further communicates with said hot end of said cylinder via a heating chamber outlet port means.

11. An energy converter as in claim 1, wherein:

said heating chamber is designed to substantially continuously heat fluid within said heating chamber during said hot rebound cycle portion, said continuous heating providing sufficient heat energy to sustain the piston oscillation.

12. The energy converter of claim 1, wherein said cooling means comprises:

a cooled load communicating with said cylinder via a load port in a wall of said cylinder in said cold end of said cylinder.

13. The energy converter of claim 12, wherein:

said load port is in said cylinder side-wall in said cold end of said cylinder.

14. The energy converter of claim 1, wherein :

said heating chamber further communicates with said hot end of said cylinder via a heating chamber outlet conduit.

15. The energy converter of claim 14 wherein:

said outlet conduit communicates with said cylinder via a heating chamber outlet port provided in a wall of said cylinder in said hot end of said cylinder.

16. The energy converter of claim 15 wherein:

said cylinder has a hot end-wall at said hot end of said cylinder; and said outlet port is located in said hot end wall.

17. The energy converter of claim 15 wherein:

said outlet port and said outlet conduit are configured, positioned, and oriented with respect to said cylinder so as to reduce interference between said stream of fluid and fluid flowing from said heating chamber into said hot end of said cylinder via said outlet conduit and said outlet port.

18. The energy converter of claim 1 wherein said means for reversing said piston motion comprises:

a variable volume cold rebound chamber within which fluid is compressed by said piston during a cold rebound portion of said cycle following said first coasting portion of said cycle;

said cold rebound chamber including said cold end of said cylinder.

19. The energy converter of claim 1 wherein:

said hot bypass conduit is oriented so that said fluid flowing into said hot end of said cylinder via said bypass during said first coasting portion of said cycle has a substantial velocity component along said cylinder axis in a direction extending from said cold end of said cylinder toward said hot end of said cylinder.

20. The energy converter of claim 1 wherein:

said hot bypass conduit is directed approximately toward said heating chamber inlet port.

21. The energy converter of claim 1 wherein:

said energy converter is configured so that most of said fluid forced via said bypass into said hot end of said cylinder in said stream enters and is heated in said heating chamber during said first coasting portion of said cycle.

22. The energy converter of claim 1 wherein :

said energy converter is configured so that substantially all of said fluid forced via said bypass into said hot end of said cylinder in said stream enters and is heated in said heating chamber during said first coasting portion of said cycle.

23. The energy converter of claim 1 wherein:

said heating chamber and said heating chamber inlet port are configured so as to readily admit fluid from said hot end of said cylinder during said hot rebound portion of said cycle and to continuously heat said admitted fluid throughout substantially all of said hot rebound portion of said cycle.

24. The energy converter of claim 1 wherein:

said cold bypass port is disposed so that the side-wall of said piston traverses and blocks said cold bypass port during a cold rebound portion of said cycle following said first coasting portion of said cycle; and said means for reversing said piston motion includes compression of the fluid within said cold end of said cylinder by said piston during said cold rebound portion of said cycle.

25. The energy converter of claim 1 wherein:

said free piston has a substantially uniform cross-section throughout substantially all of its length.

26. The energy converter of claim 1 wherein:

said free piston has substantially all segments thereof moving together as a unit throughout said cycle.

27. The energy converter of claim 1 wherein:

said heating chamber inlet port has a cross-sectional area which is greater than the cross-sectional area of said hot bypass port.

28. The energy converter of claim 1 wherein:

said heating chamber communicates with said heating chamber inlet port via a heating chamber inlet conduit which has a mean flow axis which is approximately aligned with the mean flow axis of said hot bypass conduit.

29. The energy converter of claim 1 further comprising:

means for conducting fluid between said cylinder and a load during said coasting portion of said cycle.

30. The energy converter of claim 1 wherein:

said cylinder is a substantially closed cylinder.

31. The energy converter of claim 1 wherein:

said cylinder has an end wall in said hot end of said cylinder, wherein said heating chamber inlet port is in said hot end wall.

32. The energy converter of claim 1 wherein:

said heating chamber communicates with said hot end of said cylinder by means of said heating chamber port throughout the oscillatory cycle.

33. The energy converter of claim 1 wherein:

said heating chamber is designed to substantially heat said fluid within said heating chamber while said piston is moving toward said cold end of said cylinder during blockage of said hot bypass port by said piston.

34. The energy converter of claim 1 wherein:

said heating chamber port is in a wall of said cylinder;

said heating chamber port being further from said cold end of said cylinder than is said hot bypass port.

35. The energy converter of claim 1 wherein:

said heating chamber further communicates with said cylinder by means of another heating chamber port defined in a wall of said cylinder so as to augment the entry of said fluid in said stream into said heating chamber for heating therein during said coasting.

36. The energy converter of claim 35 wherein:

said heating chamber ports are disposed further from said cold end of said cylinder than are any cylinder ports of said bypass.

37. The energy converter of claim 1 wherein:

one of said heating chamber ports is in a hot end wall of said cylinder in said hot end of said cylinder.

38. The energy converter of claim 1 wherein:

said energy converter is configured so that most of said fluid flowing in said stream flows into and thence out of said heating chamber during said first coasting portion of said cycle.

39. The energy converter of claim 1 wherein:

said piston has a sidewall which traverses and covers said hot bypass port during said hot rebound cycle portion so as to accomplish said blocking.

40. The energy converter of claim 1 wherein:

said hot bypass port, said heating chamber inlet port, and the axis of said cylinder are all in the same plane.

41. An energy converter as in claim 1, further including:

a load port defined in a wall of the cylinder in said cold cylinder end, said load port being disposed at approximately the same longitudinal position along the length of the cylinder as is said cold bypass port.

42. An energy converter comprising:

a cylinder fitted with a free piston sized to form a sliding seal with the cylinder as the piston oscillates between and separates hot and cold ends of the cylinder;

a cylinder bypass bypassing a portion of the cylinder so as to allow a compressible fluid to alternately flow back and forth between said hot and cold ends of the cylinder as the piston moves in alternate directions between said cylinder ends;

means for cooling the fluid flowing into the cold cylinder end and for heating the fluid flowing into the hot cylinder end thereby producing a cyclical fluid pressure variation utilizable for driving a load;

said heating means including a heating chamber disposed outside of the bypass and communicating with the hot end of the cylinder via a heating chamber inlet conduit, said inlet conduit communicating with the hot end of the cylinder via a heating chamber inlet port defined in the hot end of the cylinder;

said bypass including, in seriatim, a cold bypass port defined in said cold end of the cylinder, a hot bypass conduit, and a hot bypass port defined in the sidewall of the cylinder in said hot end of the cylinder, whereby the fluid exiting the hot end of the bypass via said hot bypass port flows into the hot end of the cylinder in a substantially defined stream during a first portion of the oscillatory cycle while the piston is moving in the bypass region of the cylinder toward the cold end of the cylinder;

means for positioning and aligning said hot bypass conduit and said heating chamber inlet port with respect to each other and with respect to the hot end of the cylinder so as to augment passage of said fluid in said stream into said heating chamber via said inlet port and said inlet conduit for heating fluid in the heating chamber during said first portion of the cycle;

said piston during a hot rebound portion of the oscillatory cycle blocking said hot bypass port and compressing and forcing fluid from the hot end of the cylinder into said heating chamber for heating therein for expanding and driving said piston toward the cold cylinder end with a greater piston kinetic energy at the end of the hot rebound cycle portion than the kinetic energy of the piston at the beginning of the hot rebound cycle portion; and means for reversing the piston motion at the cold cylinder end.

* * * * *

UNITED STATES PATENT OFFICE

CERTIFICATE OF CORRECTION

Patent No. 4,072,010 Dated February 7, 1978

Inventor(s) Mark Schuman

It is certified that error appears in the above-identified patent and that said Letters Patent are hereby corrected as shown below:

The term of this patent subsequent to March 22, 1994 has been disclaimed.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*